US006405940B2

(12) United States Patent
Harcombe et al.

(10) Patent No.: US 6,405,940 B2
(45) Date of Patent: Jun. 18, 2002

(54) FUEL INJECTOR

(75) Inventors: Anthony Thomas Harcombe, Richmond (GB); Michael Colin Wickstone, Vancouver (CA)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/769,948

(22) Filed: Jan. 25, 2001

(30) Foreign Application Priority Data

Jan. 27, 2000 (GB) ..... 0001766

(51) Int. Cl.[7] ..... F02M 47/02; F02M 51/00

(52) U.S. Cl. ..... 239/88; 239/585.1; 239/90; 239/91; 239/93; 239/95; 239/96

(58) Field of Search ..... 239/88, 90, 91, 239/92, 93, 94, 95, 96, 585.1; 251/129.1, 129.09; 335/232, 266, 267, 268

(56) References Cited

U.S. PATENT DOCUMENTS 6,113,014 A * 9/2000 Coldren et al. ..... 239/88
6,260,768 B1 * 7/2001 Timms ..... 239/88
6,267,306 B1 * 7/2001 Phillips ..... 239/88
6,321,999 B1 * 11/2001 Male et al. ..... 239/96

* cited by examiner

*Primary Examiner*—Robin O. Evans
(74) *Attorney, Agent, or Firm*—Thomas N. Twomey

(57) ABSTRACT

A fuel injector for use in an injector arrangement including a fuel pump having a pump chamber and a spill valve arrangement including a spill valve member which is engageable with a valve seating to control communication between the pump chamber and a low pressure drain. The fuel injector further comprises a valve needle which is engageable with a valve needle seating, a control chamber arranged such that the fuel pressure therein urges the valve needle towards its seating, a control valve arrangement, including a control valve member, for controlling the fuel pressure within the chamber, and an actuator arrangement for controlling movement of the spill valve member and the control valve member. The actuator arrangement comprises a double pole actuator having a first armature which is movable with the spill valve member and a single pole actuator having a second armature which is movable with the control valve member.

14 Claims, 4 Drawing Sheets

FIG. 2 A – A

FUEL INJECTOR

This invention relates to an fuel injector for use in supplying fuel, under pressure, to the cylinders of an internal combustion engine.

A known fuel injector arrangement comprises a plunger reciprocable within a bore provided in a housing to pressurize fuel located within a pump chamber defined by the bore. The pump chamber communicates with a fuel pressure actuated injector such that once the fuel pressure within the pump chamber exceeds a predetermined level, the injector opens and, thus, fuel injection commences.

In order to permit independent control of the injection pressure and the timing of injection, it is known to provide a spill valve which communicates with the pump chamber, and an injection control valve which controls the pressure applied to a control chamber defined, in part, by a surface associated with a needle of the injector to control movement of the needle. In use, the spill valve remains open during initial inward movement of the plunger. Subsequently, the spill valve is closed, further inward movement of the plunger pressurizing the fuel within the pump chamber. When injection is to commence, the injection control valve is actuated to connect the control chamber to a low pressure drain thus permitting movement of the needle away from its seating to commence fuel injection.

It has also been proposed to arrange the injection control valve such that it is biased into a position in which the control chamber communicates with the low pressure drain. Actuation of the injection control valve causes communication between the low pressure drain and the control chamber to be broken and permits fuel under high pressure to flow into the control chamber.

Conventionally, movement of the spill valve and the injection control valve is controlled by means of two separate actuators. Each actuator comprises a winding and two poles, each winding requiring separate and independent electrical connections. The electrical connections to the actuators can be difficult to accommodate within the fuel injector housing. Furthermore, the twin-poles of each actuator occupy a relatively large space. This has disadvantages in terms of size and cost.

It is an object of the present invention to provide a fuel injector which alleviates these disadvantages.

According to the present invention there is provided a fuel injector for use in an injector arrangement including a fuel pump having a pump chamber and a spill valve arrangement including a spill valve member which is engageable with a spill valve seating to control communication between the pump chamber and a low pressure drain, a valve needle which is engageable with a valve needle seating, a control chamber arranged such that the fuel pressure therein urges the valve needle towards its seating, a control valve arrangement, including a control valve member, for controlling the fuel pressure within the control chamber, and an actuator arrangement for controlling movement of the spill valve member and the control valve member, the actuator arrangement comprising a double pole actuator having a first armature which is movable with the spill valve member and a single pole actuator having a second armature which is movable with the control valve member.

The invention provides the advantage that a reduced space is required to accommodate the actuator arrangement as one of the actuators is of the single pole type.

Conveniently, the spill valve member is of relatively large diameter and the control valve member is of smaller diameter. The control valve member may be engageable with first and second control valve seatings to control communication between the pump chamber and the control chamber and between the control chamber and the low pressure drain.

Conveniently, the control valve member may be provided with resilient bias means for biasing the control valve member against the second control valve seating to close communication between the control chamber and the low pressure drain. Conveniently, the spill valve member may be provided with further resilient bias means for biasing the spill valve member away from the spill valve seating to open communication between the pump chamber and the low pressure drain.

The first and further resilient bias means may take the form of first and second compression springs. Alternatively, the first and further resilient bias means may be provided by a single compression spring.

Although the single pole actuator only provides a relatively weak force, as the control valve member is only of relatively small diameter the force provided by the single pole actuator is sufficient to move the control valve member away from the second control valve seating against the first control valve seating. The double pole actuator provides a larger force which permits a spill valve member of relatively large diameter to be employed. As the spill valve member can have a relatively large diameter, a relatively high rate of flow of fuel is permitted past the spill valve seating when the spill valve is open.

The actuator arrangement is conveniently housed within an actuator housing. The actuator housing may be provided with a drilling which forms part of a supply passage for fuel which communicates with the pump chamber. It is possible for the supply passage to be formed, in part, within the actuator housing as the actuator arrangement occupies a reduced space within the actuator housing.

Conveniently, the actuator arrangement comprises first and second windings associated with first and second actuators respectively. The first and second windings may be arranged such that they share a common electrical connection. Thus, fewer electrical connections to the fuel injector are required.

According to another aspect of the present invention, there is provided an actuator arrangement for use in an injector arrangement including a fuel pump having a pump chamber, a spill valve arrangement including a spill valve member which is engageable with a spill valve seating to control communication between the pump chamber and a low pressure drain and a control valve arrangement, including a control valve member, for controlling the fuel pressure within a control chamber, the actuator arrangement comprising a double pole actuator having a first armature which is movable with the spill valve member and a single pole actuator having a second armature which is movable with the control valve member.

The invention will now be described, by way of example only, with reference to the accompanying drawings in which.

Figure 1:
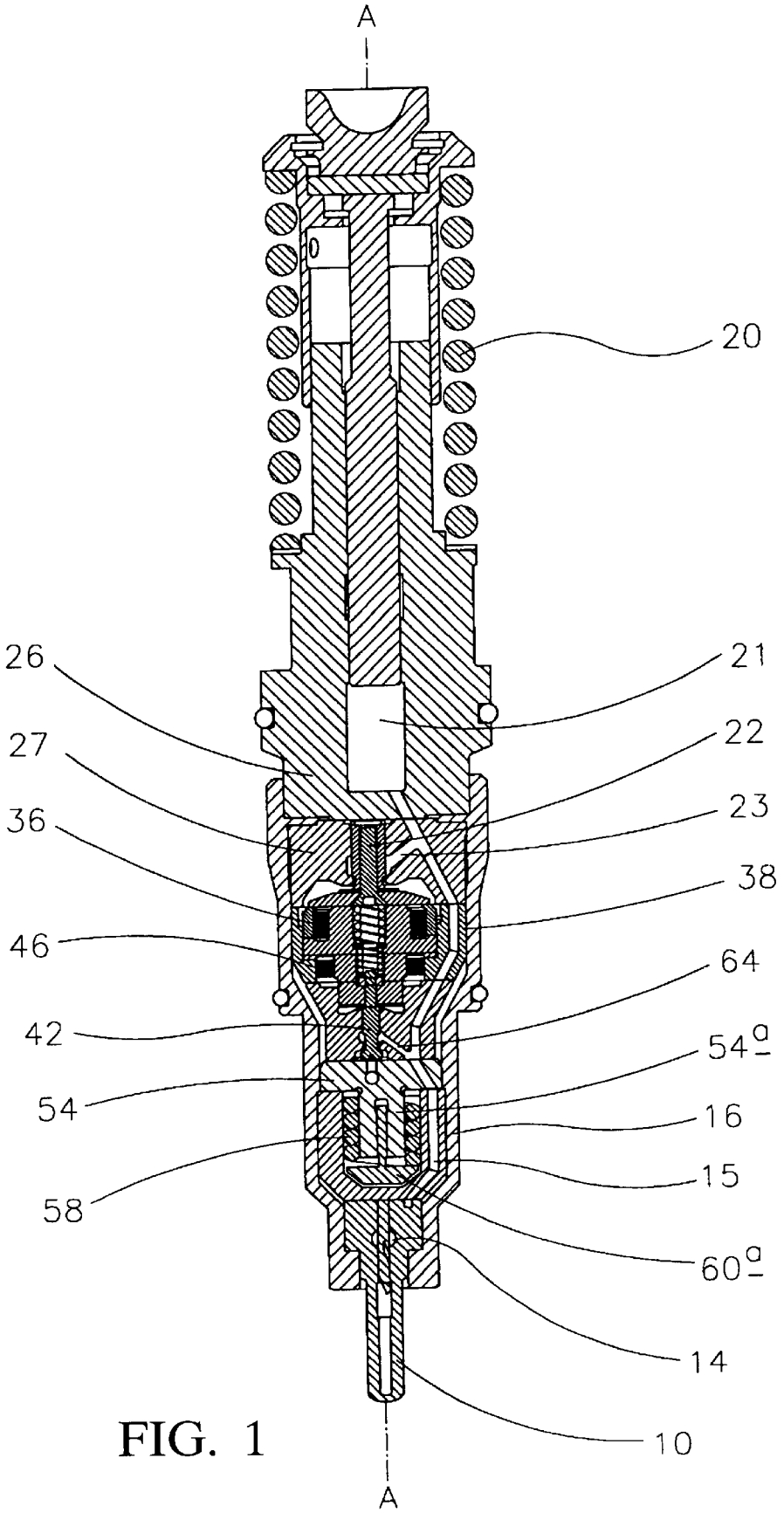
FIG. 1 shows a sectional view of a fuel injector in accordance with an embodiment of the invention.
Figure 2:
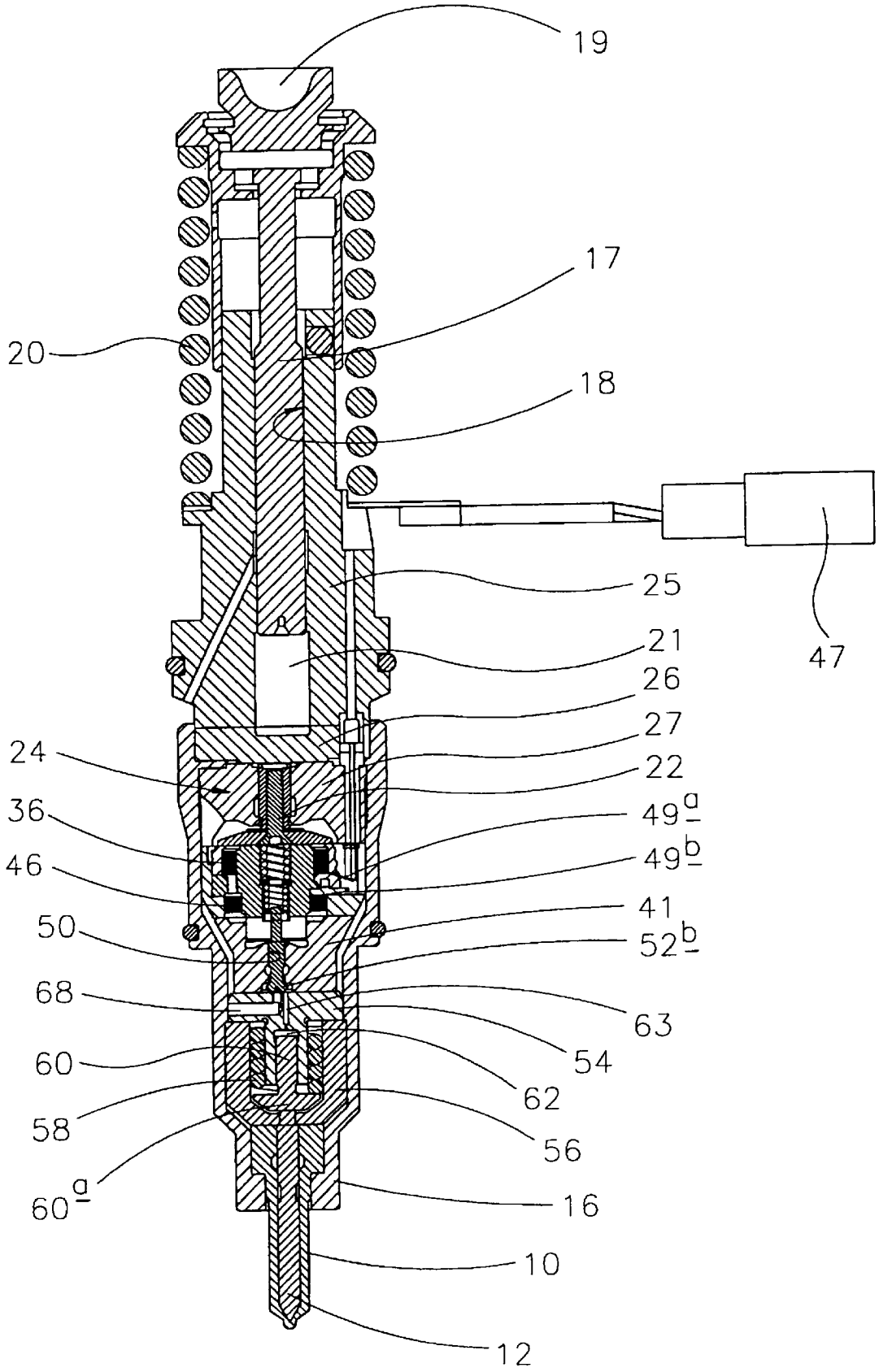
FIG. 2 shows a sectional view of the fuel injector in FIG. 1 approximately along line A—A.

Referring to FIGS. 1 and 2, the fuel injector comprises a nozzle body 10 which is provided with a bore within which a valve needle 12 is reciprocable. The bore includes an enlarged diameter region which defines an annular chamber 14 for fuel, fuel being supplied to the annular chamber 14 and the bore through a supply passage 15 defined by drillings formed in the nozzle body 10 and in various fuel injector housing parts, to be described hereinafter. The valve needle 12 is engageable with a seating to control fuel delivery through one or more outlet openings (not shown) provided in the nozzle body 10. The housing parts and the nozzle body 10 are secured within a cap nut 16.

The injector further includes a pump unit comprising a plunger member 17 which is reciprocable within a plunger bore 18 provided in a housing 25 under the action of a cam arrangement, only a tappet member 19 of which is shown, a return spring 20 being provided in order to withdraw the plunger member 17 from the plunger bore 18. The housing 25 abuts, at its lowermost end, a further housing 26 which is provided with a recess which defines, together with the plunger bore 18, a pump chamber 21 for fuel. The pump chamber 21 communicates with a spill valve arrangement, referred to generally as 24, by means of the supply passage 15 and a passage 23 provided in an additional housing 27 in abutment with the further housing 26. The supply passage 15 also permits fuel to flow from the pump chamber 21 to the annular chamber 14 and the bore provided in the nozzle body 10, fuel within the bore acting against appropriately orientated thrust surfaces (not shown) of the valve needle 12 to urge the needle 12 away from its seating provided in the nozzle body 10.

Figure 3:
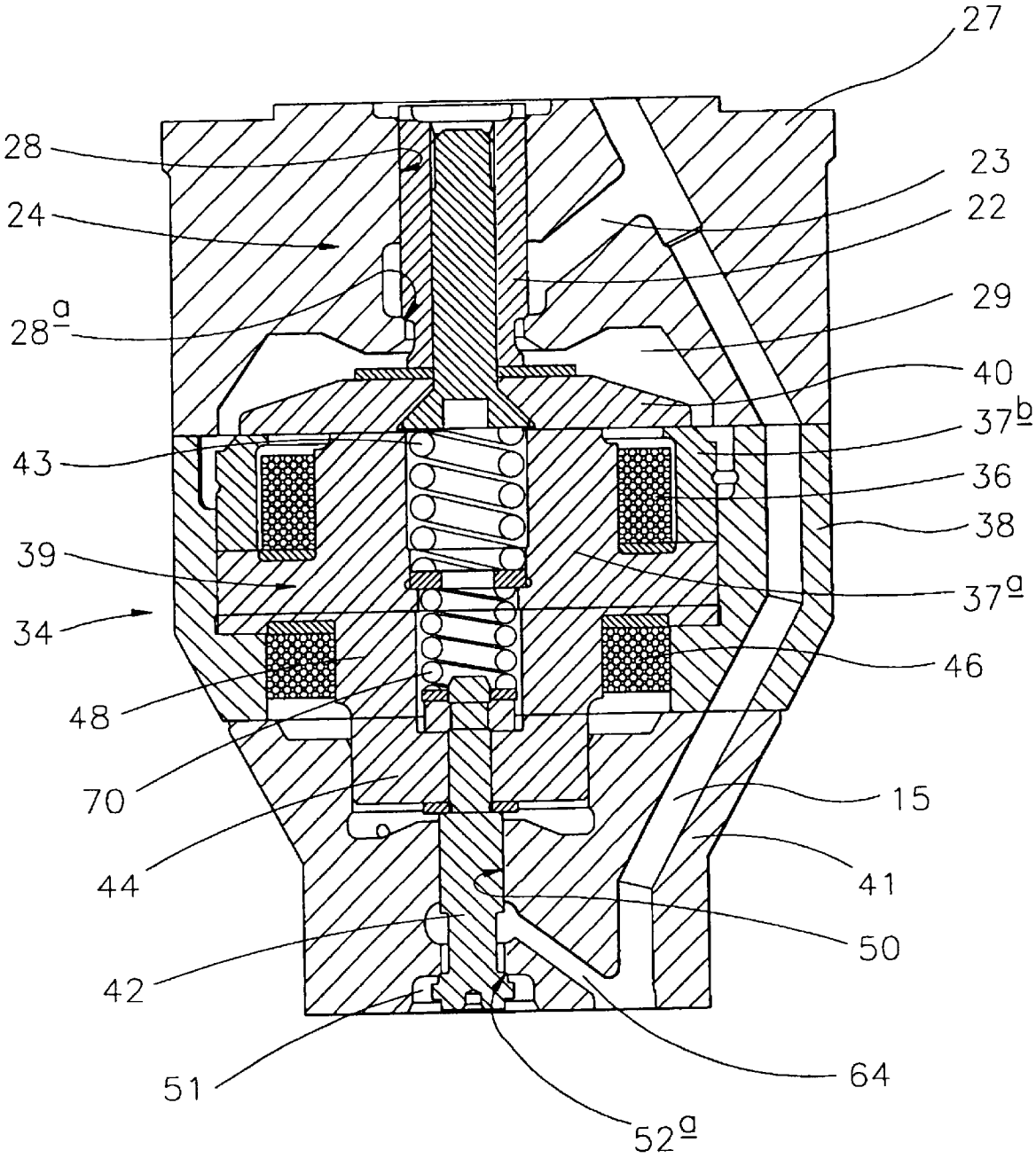
FIG. 3 is a sectional view of the actuator arrangement forming part of the fuel injector in FIGS. 1 and 2.

As can be seen most clearly in FIG. 3, the spill valve arrangement 24 includes a spill valve member 22 which is slidable within a further bore 28 provided in the further housing 27, the further bore 28 opening into a chamber 29 which is connected to a low pressure drain or reservoir. The spill valve member 22 is engageable with a seating 28*a* defined by the further bore 28 to control communication between the pump chamber 21 and the chamber 29 and, hence, between the pump chamber 21 and the low pressure drain. Movement of the spill valve member 22 is controlled by means of a first actuator forming part of an electromagnetic actuator arrangement, referred to generally as 34. The actuator arrangement 34 includes first and second actuators having first and second actuator windings 36, 46 respectively. The first actuator winding 36 is associated with two poles 37*a*, 37*b* and the second actuator winding 46 is associated with a single pole 48, the poles 37*a*, 37*b*, 48 and the windings 36, 46 being located within an actuator housing 38. The windings 36, 46 are spaced apart vertically by an annular bridging region 39.

The actuator arrangement 34 further comprises first and second armatures 40, 44. The first armature 40 is connected to the valve member 22 such that the spill valve member 22 is movable with the first armature 40, the first armature 40 being movable under the influence of a magnetic field generated by supplying a current to the first winding 36. The second armature 44 is associated with an injection control valve arrangement, as will be described hereinafter, the second armature 44 being moveable under the influence of a magnetic field generated by supplying a current to the second winding 46. The actuator windings 36, 46 are supplied with current from an external control unit 47 by means of electrical connectors 49*a*, 49*b* respectively.

The spill valve member 22 is engageable with a seating 28*a* defined by part of the further bore 28 such that, when the spill valve member 22 engages the seating 28*a*, communication between the pump chamber 21 and the low pressure drain is not permitted. A first spring 43 is located so as to bias the spill valve member 22 towards a position in which the spill valve member 22 is lifted away from its seating 28*a*, energization of the winding 36 causing the first armature 40 and the valve member 22 to move against the force due to the first spring 43, the spill valve member 22 thereby moving into engagement with the seating 28*a* to break communication between the pump chamber 21 and the low pressure drain.

The actuator housing 38 abuts, at its end remote from the additional housing 27, a second further housing 41 for an injection control valve arrangement. The injection control valve arrangement includes a control valve member 42 which is slidable within a through bore 50 provided in the second housing 41 under the control of the second actuator, as described previously. The control valve member 42 is connected to the second armature 44 and is movable therewith between first and second seated positions, a first position in which the control valve member 42 engages a first valve seating 52*a* defined by the through bore 50 and a second position in which the control valve member 42 engages a second valve seating 52*b* defined by the upper end face of a distance piece 54 in abutment with the second further housing 41.

The distance piece 54 abuts, at its end remote from the second further housing 41, a still further housing 56 which is provided with a bore including a region of enlarged diameter, the distance piece 54 including a projection 54*a* which extends within the enlarged diameter bore region and defines, together with the enlarged diameter bore region, a spring chamber within which a second compression spring 58 is housed. The projection 54*a* forming part of the distance piece 54 is also provided with a blind bore within which a piston member 60 is slidable, the piston member 60 including an enlarged diameter region 60*a* which is connected to the upper end of the valve needle 12 such that movement of the piston member 60 within the through bore 50 is transmitted to the valve needle 12. The end region 60*a* of the piston member 60 abuts the second spring 58, the second spring 58 serving to bias the piston member 60 and the valve needle 12 in a downwards direction such that the valve needle 12 is urged against its seating.

The upper end face of the piston member 60 and the blind end of the bore provided in the distance piece 54 together define a control chamber 62 for fuel.

The control chamber 62 communicates with a passage 63 provided in the distance piece 54, the passage 63 communicating, at its other end, with a passage 64 provided in the second further housing 41 which communicates with the supply passage 15. The passage 64 communicates, intermittently, with an annular chamber 51 defined by an enlarged region of the through bore 50, the chamber 51 communicating, intermittently, with a passage 68 provided in the distance piece 54 in communication with the low pressure drain. The control valve member 42 is engageable with the first and second valve seatings 52*a*, 52*b* respectively to control communication between the control chamber 62 and the supply passage 15 and between the control chamber 62 and the low pressure drain.

An additional spring 70 is located so as to bias the control valve member 42 towards a position in which the valve member 42 is seated against the second valve seating 52*b* such that communication between the supply passage 15 and the control chamber 62 is permitted. Thus, in use, with the winding 46 de-energized and with the valve member 42 seated against the second valve seating 52*b*, fuel in the supply passage 15 is able to flow past the first valve seating 52*a* into the control chamber 62, and communication between the control chamber 62 and the low pressure drain is broken. During this stage of operation, fuel pressure within the control chamber 62 is therefore substantially equal to that within the supply passage 15. The effective areas of the piston member 60 and the valve needle thrust surfaces are chosen to ensure that, in such circumstances, the force acting on the valve needle 12 due to the fuel pressure within the control chamber 62 and due to the action of the spring 58 is sufficient to urge the valve needle 12 into engagement with its seating. In such circumstances, fuel injection through the outlet openings does not take place.

When the second winding 46 is energized, the second armature 44 is moved towards the single pole 48 and the control valve member 42 is moved away from the second valve seating 52*b*, against the force due to the second spring 70, into engagement with the first valve seating 52*a*. Under these circumstances, fuel in the supply passage 15 is unable to flow past the first valve seating 52*a* into the control chamber 62 and the control chamber 62 communicates with the low pressure drain. As a result, fuel pressure within the control chamber 62 decreases. It will be appreciated that, in such circumstances, the force acting on the valve needle 12 urging the valve needle 12 into engagement with its seating is decreased. The effective areas of the piston member 60 and the valve needle thrust surfaces are chosen to ensure that, in such circumstances, the valve needle 12 is urged away from its seating to commence fuel injection through the outlet openings.

When the second winding 46 is de-energized, the control valve member 42 returns to a position in which it seats against the second valve seating 52*b*. Under these circumstances, communication between the supply passage 15 and the control chamber 62 is re-established, and the control chamber 62 communicates with the supply passage 15. Fuel pressure within the control chamber 62 is therefore increased, the effective area of the thrust surfaces provided on the valve needle 12 and the effective area of the piston member 60 exposed to fuel pressure within the control chamber 62 being such that, under these circumstances, the downward force applied to the valve needle 12 is sufficient to move the valve needle 12 towards its seating such that fuel delivery through the outlet openings is terminated.

In use, with the pump chamber 21 charged with fuel, and starting from a position in which the plunger member 17 is in its outermost position within the plunger bore 18 and with the first and second actuator windings 36, 46 de-energized, the spill valve member 22 is biased away from the seating 28*a* by the spring 43 such that the pump chamber 21 communicates with the low pressure drain. Additionally, the control valve member 42 is in engagement with the second valve seating 52*b* such that the control chamber 62 communicates with the supply passage 15. In such circumstances, the valve needle 12 engages its seating under the action of the spring 58 and fuel injection does not take place, as described previously.

From this position, the plunger member 17 commences inward movement into the plunger bore 18 under the action of the cam arrangement, such movement resulting in fuel being displaced from the pump chamber 21, past the spill valve seating 28*a* to the low pressure drain. When it is determined that pressurization of the fuel within the pump chamber 21 should commence, firstly the first actuator winding 36 for the spill valve member 22 is energized, resulting in movement of the spill valve member 22 against the seating 28*a* to break communication between the pump chamber 21 and the low pressure reservoir. It will be appreciated that continued inward movement of the plunger 17 within the plunger bore 18 therefore results in the pressure of fuel within the pump chamber 21, and the supply passage 15, increasing. Thus, relatively high pressure fuel is supplied through the supply passage 15 to the annular chamber 14 and the bore provided in the nozzle body 10 and the pressure of fuel applied to the thrust surfaces of the valve needle 12 is increased. As the control valve member 42 is seated against the second valve seating 52*b*, communication between the control chamber 62 and the supply passage 15 ensures that a sufficiently high force is applied to the piston member 60 and the valve needle 12 due to fuel pressure within the control chamber 62 which, combined with the spring force due to the spring 58, maintains engagement between the valve needle 12 and its seating. Thus, fuel injection does not take place during this stage of operation.

When fuel pressurization within the pump chamber 21 has increased to a sufficiently high level, and fuel injection is to be commenced, the actuator winding 46 is energized to move the armature 44 towards the single pole 48. The control valve member 42 therefore moves away from the second valve seating 52*b*, against the action of the spring 70, into engagement with the first valve seating 52*a*. Such movement of the control valve member 42 breaks communication between the control chamber 62 and the supply passage 15 and instead permits communication between the control chamber 62 and the low pressure drain. The pressure within the control chamber 62 is therefore reduced which results in a reduction in the force urging the valve needle 12 into engagement with its seating. A point will be reached at which the force applied to the thrust surfaces of the valve needle 12 is sufficient to overcome the action of the spring 58 and the reduced fuel pressure within the control chamber 62. The valve needle 12 then lifts away from its seating to permit fuel to flow past the valve needle seating provided in the nozzle body 10 and through the outlet openings to commence fuel injection.

In order to terminate fuel injection, the first actuator winding 36 is de-energized such that the first armature 40 moves away from the poles 37*a*, 37*b*, causing the spill valve member 22 to lift away from the seating 28*a*. Fuel within the pump chamber 21 is therefore able to flow to the low pressure drain causing fuel pressure within the supply passage 15 and the bore provided in the nozzle body 10 to be reduced. A point will be reached when the force due to the spring 58 is sufficient to overcome the reduced fuel pressure acting on the thrust surfaces of the valve needle 12 such that the valve needle 12 returns to its seated position. In such circumstances, fuel delivery through the outlet openings ceases.

Alternatively, fuel injection may be terminated by de-energizing the second actuator winding 46 such that the second armature 44 is moved away from the single pole 48 causing the control valve member 42 to move away from the first valve seating 52*a* into engagement with the second valve seating 52*b*. This re-establishes communication between the supply passage 15 and the control chamber 62. The force applied to the piston member 60 and the valve needle 12 due to fuel pressure within the control chamber 62, combined with the force due to the spring 58, is sufficient to overcome the fuel pressure acting on the thrust surfaces of the valve needle 12 and the valve needle 12 is therefore returned against its seating to cease fuel injection. At or after termination of injection, the first actuator winding 36 is de-energized and the spill valve member 22 moves away from the seating 28*a* under the action of the spring 43, in which position the pump chamber 21 communicates with the low pressure drain causing fuel pressure within the pump chamber 21 to be reduced. Continued inward movement of the plunger member 17 within the plunger bore 18 results in further fuel being displaced past the spill valve seating 28*a* to the low pressure drain.

The seating 28*a* with which the spill valve member 22 is engageable has a relatively large diameter such that, during the filling phase of the injection cycle, a relatively large volume of fuel is able to flow into the pump chamber 21. The spill valve member 22 is also therefore of relatively large diameter and a relatively large force is required to urge the spill valve member 22 against the seating 28*a* to close communication between the pump chamber 21 and the low pressure drain. This relatively large force is achieved by employing the two poles 37*a*, 37*b* in combination with the first winding 36. However the control valve member 42 need only be of relatively small diameter compared to the diameter of the spill valve member 22, as only a relatively low rate of flow of fuel to and from the control chamber 62 is required. Thus, the control valve member 42 also has a relatively small diameter and only a relatively weak force is required to move the control valve member 42 against the first seating 52*a*. This smaller force can be achieved using the second winding 46 in combination with a single pole 48 having a relatively small armature 44 associated therewith. By using a single pole 48, in place of a double pole, in the actuator for the control valve member 42, a reduced space is required to accommodate the actuator arrangement 34 whilst ensuring a sufficiently high force can be achieved to move the control valve member 42 against the first seating 52*a*. As the actuator arrangement 34 occupies a reduced space within the actuator housing 38, the supply passage 15 can be formed, in part, within the housing 38.

Furthermore, when the actuator winding 36 is energized, to cause movement of the spill valve member 22 towards the seating 28*a*, flux is able to pass through the bridging region 39 between the first and second windings 36, 46. Similarly, when the second actuator winding 46 is energized, to move the second armature 44 and the control valve member 42 against the first seating 52*a*, flux is able to pass through the bridging region 39 between the first and second windings 36, 46. By winding both the first and second windings 36, 46 in such a manner that the flux flow in the first and second windings 36, 46 flows in the same direction, only a small amount of net flux passes through the bridging region 39. Thus, the bridging region 39 of the actuator arrangement need only be of relatively small size.

The actuator arrangement provides the further advantage that, due to the close proximity of the first and second windings 36, 46, the windings 36, 46 may share a common electrical connection, thereby reducing the total number of electrical connections required to the fuel injector.

Figure 4:
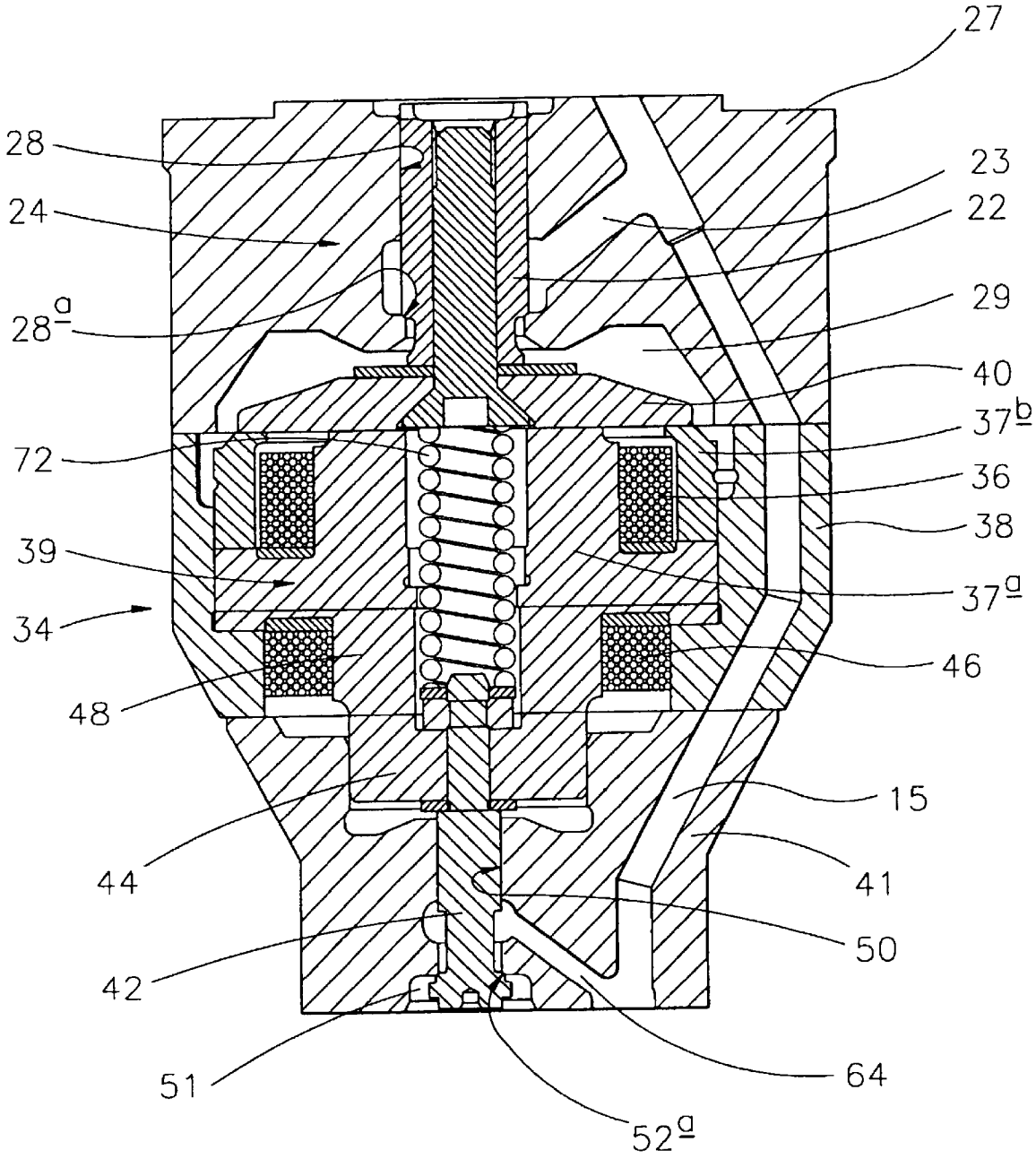
FIG. 4 is a sectional view similar to that in FIG. 3, of an alternative embodiment of the invention.

As shown in FIG. 4, in an alternative embodiment of the invention, the first and additional springs 43, 70 may be replaced by a single spring 72 arranged to apply appropriate biasing forces to both the control valve member 42 and the spill valve member 22. Additionally, it will be appreciated that the first, second and additional compression springs 43, 58, 70 may be replaced with any resilient bias means to provide the necessary biasing forces.

In the embodiment shown in FIGS. 1 to 3, it can be seen that the spill valve member 22 is secured to the first armature 40 by means of a screw which extends through a bore provided in the spill valve member 22. Additionally, it can be seen that the control valve member 42 is secured to the second armature 44 by means of a screw arrangement. In an alternative embodiment of the invention either the spill valve member 22, the control valve member 42, or both members, may be secured to their respective armatures 40, 44 by means of welding.

The spill valve member 22 and the control valve member 42 may be arranged such that, when the winding 36 is de-energized, the spill valve member 22 adopts a position in which communication between the pump chamber 21 and the low pressure drain is closed, and when the second winding 46 is de-energized, the control valve member 42 adopts a position in which communication between the control chamber 62 and the supply passage 15 is closed. It will also be appreciated that the spill and injection control valve arrangements may be of a different form to those described hereinbefore.

What is claimed is:

1. A fuel injector for use in an injector arrangement including a fuel pump having a pump chamber and a spill valve arrangement, the spill valve arrangement including a spill valve member which is engageable with a spill valve seating to control communication between the pump chamber and a low pressure drain and a valve needle which is engageable with a valve needle seating, a control chamber arranged such that the fuel pressure therein urges the valve needle towards its seating, a control valve arrangement, including a control valve member, for controlling the fuel pressure within the control chamber, and an actuator arrangement for controlling movement of the spill valve member and the control valve member, the actuator arrangement comprising a double pole actuator having a first armature which is movable with the spill valve member and a single pole actuator having a second armature which is movable with the control valve member.

2. A fuel injector as claimed in claim 1, wherein the spill valve member has a relatively large diameter compared with the diameter of the control valve member.

3. A fuel injector as claimed in claim 2, wherein the control valve member is engageable with first and second control valve seatings to control communication between the pump chamber and the control chamber and between the control chamber and the low pressure drain respectively.

4. A fuel injector as claimed in claim 3, the control valve member is provided with first resilient bias means for biasing the control valve member against the second control valve seating to close communication between the control chamber and the low pressure drain.

5. A fuel injector as claimed in claim 4, wherein the spill valve member is provided with second resilient bias means for biasing the spill valve member away from the spill valve seating to open communication between the pump chamber and the low pressure drain.

6. A fuel injector as claimed in claim 5, wherein the first and second resilient bias means take the form of first and second compression springs respectively.

7. A fuel injector as claimed in claim 5, wherein the first and second resilient bias means take the form of a single compression spring arranged to apply biasing forces to both the control valve member and the spill valve member.

8. A fuel injector as claimed in claim 1, wherein the actuator arrangement is housed within an actuator housing, the actuator housing being provided with a drilling which forms part of a supply passage for fuel in communication with the pump chamber.

9. A fuel injector as claimed in claim 1, wherein the actuator arrangement comprises first and second windings associated with first and second actuators respectively.

10. A fuel injector as claimed in claim 9, wherein the first and second windings are arranged such that they share a common electrical connection to permit current to be supplied thereto.

11. An actuator arrangement for use in an injector arrangement including a fuel pump having a pump chamber, a spill valve arrangement including a spill valve member which is engageable with a spill valve seating to control communication between the pump chamber and a low pressure drain and a control valve arrangement, including a control valve member, for controlling the fuel pressure within a control chamber, the actuator arrangement comprising a double pole actuator having a first armature which is movable with the spill valve member and a single pole actuator having a second armature which is movable with the control valve member.

12. An actuator arrangement as claimed in claim 11, further comprising first resilient bias means arranged to bias the control valve member against the second control valve seating to close communication between the control chamber and the low pressure drain.

13. An actuator arrangement as claimed in claim 12, further comprising second resilient bias means for biasing the spill valve member away from the spill valve seating to open communication between the pump chamber and the low pressure drain.

14. An actuator arrangement as claimed in claim 13, wherein the first and second resilient bias means take the form of a single compression spring arranged to apply biasing forces to both the control valve member and the spill valve member.

* * * * *